United States Patent [19]

Garbini

[11] 4,042,280

[45] Aug. 16, 1977

[54] METHOD OF BREAKING UP OBJECTS

[75] Inventor: Louis K. Garbini, Abtwil, Switzerland

[73] Assignee: Kubatec Kunststoff- & Bautechnik AG, Eschen, Switzerland

[21] Appl. No.: 523,135

[22] Filed: Nov. 12, 1974

[30] Foreign Application Priority Data

Nov. 13, 1973 Switzerland ..... 15920/73

[51] Int. Cl.[2] ..... E21C 45/00

[52] U.S. Cl. ..... 299/13; 60/632; 241/1; 299/16; 299/22

[58] Field of Search ..... 60/632, 635; 102/22, 102/23; 241/1; 299/13, 16, 22

[56] References Cited

U.S. PATENT DOCUMENTS

| | | | |
|---|---|---|---|
| 1,354,861 | 10/1920 | Tongue | 299/22 |
| 1,460,508 | 7/1923 | Sickman | 299/22 |
| 1,477,601 | 12/1923 | Sickman | 299/22 |
| 1,520,343 | 12/1924 | Green | 102/22 |
| 1,966,421 | 7/1934 | Towler | 60/547 |
| 2,032,185 | 2/1936 | Sciaky | 60/547 |
| 2,141,827 | 12/1938 | Schlumberger | 102/22 |
| 2,425,467 | 8/1947 | Hair | 299/22 |
| 3,234,727 | 2/1966 | Filer | 60/632 |

*Primary Examiner*—Carroll B. Dority, Jr.
*Assistant Examiner*—David D. Reynolds
*Attorney, Agent, or Firm*—Kurt Kelman

[57] ABSTRACT

Method of breaking up objects, particularly concrete, blocks of rock, machines, and motors, and an installation for carrying out the method.

15 Claims, 13 Drawing Figures

Fig. 2
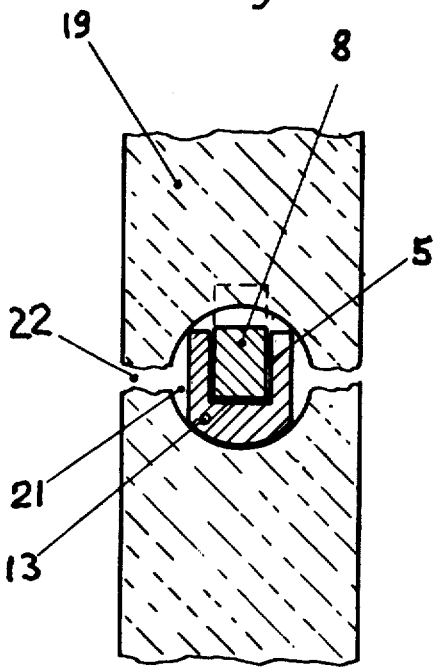
Fig. 3
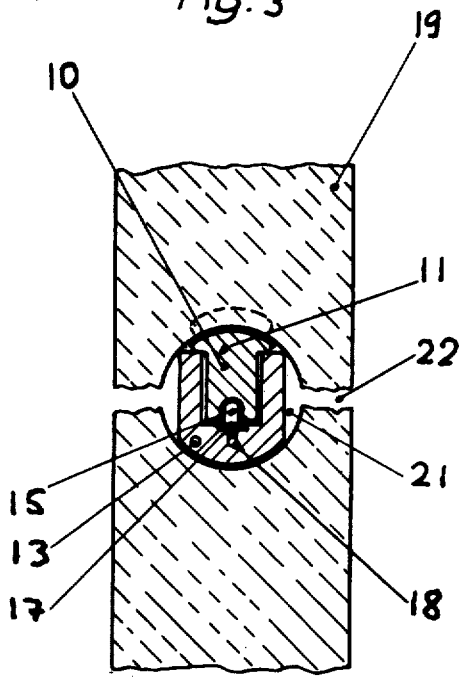
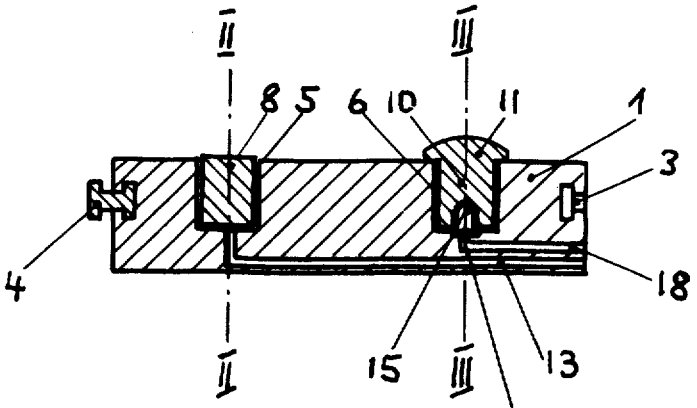
Fig. 1

Fig. 5
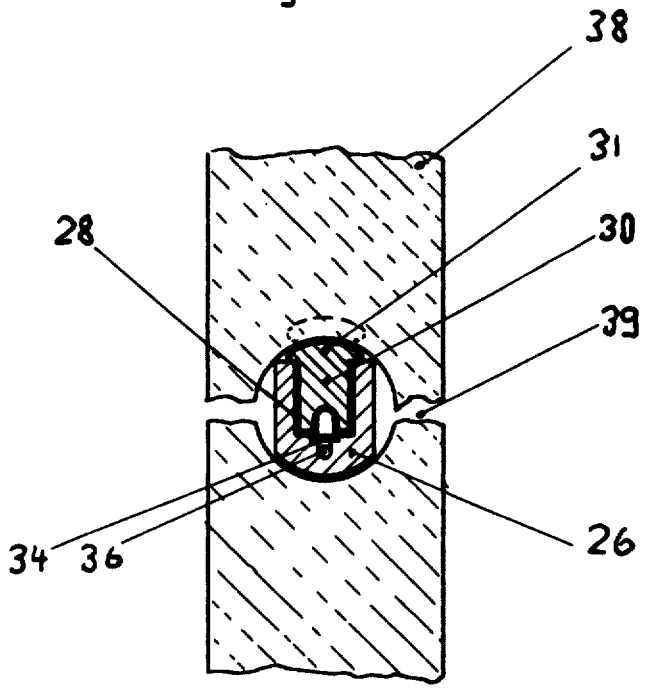
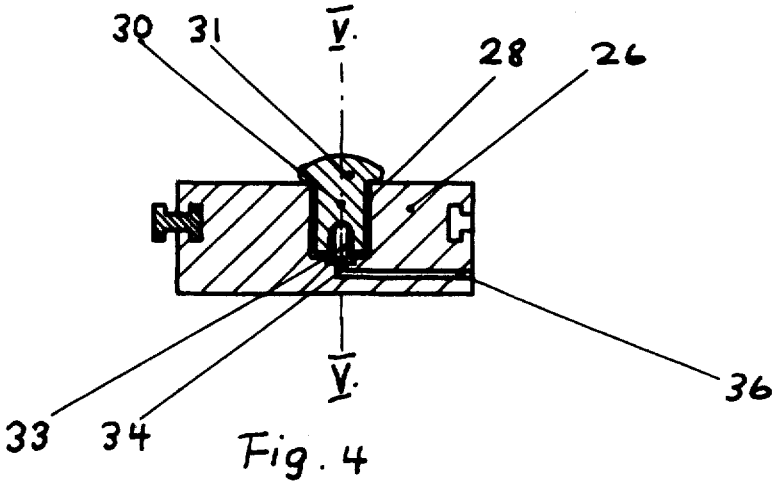
Fig. 4

METHOD OF BREAKING UP OBJECTS

The present invention relates to a method of breaking up objects, particularly concrete, blocks of rock, machines, and motors, and also to an installation for carrying out the method.

The technique generally employed for breaking up objects of this kind, when these consist of masonry or structures, comprises either demolishing them with explosives or cutting them up with the aid of thermal lances after the style of flame-cutting, this last-mentioned method also being applied to machine frames. In addition, it is known to demolish or break up objects, particularly metal objects, by means of presses.

The aim of the present invention is to provide a simple method of solving this problem without using heavy machines or equipment.

The method of the invention is characterised in that the breaking-up is effected by means of thrust pistons operated hydraulically and/or by means of an explosive. The installation for carrying out the method of the invention is characterised by at least one apparatus having at least one hydraulically operated thrust piston and/or at least one thrust piston operated by an explosive, this apparatus being intended for insertion into an aperture in the object which is to be broken up.

Figure 6:
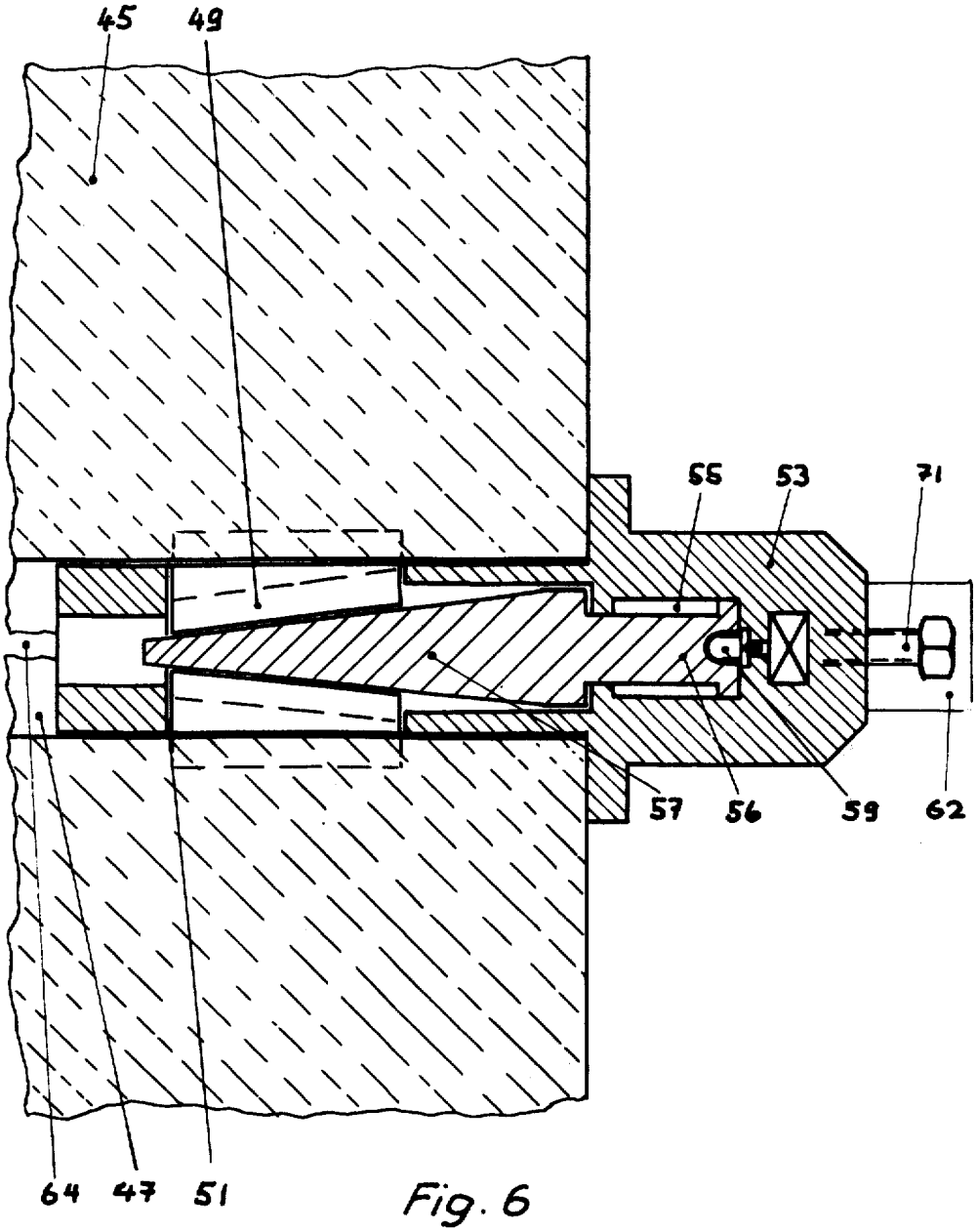
Figure 7:
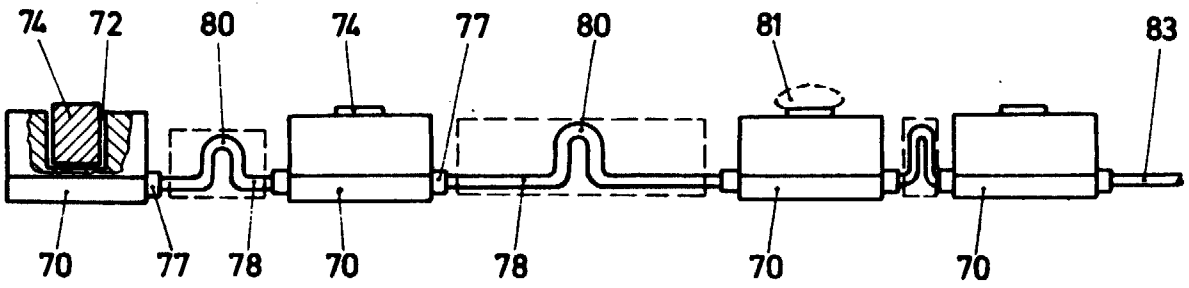
Figure 8:
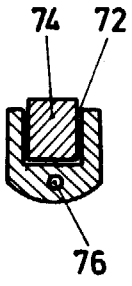
Figure 9:
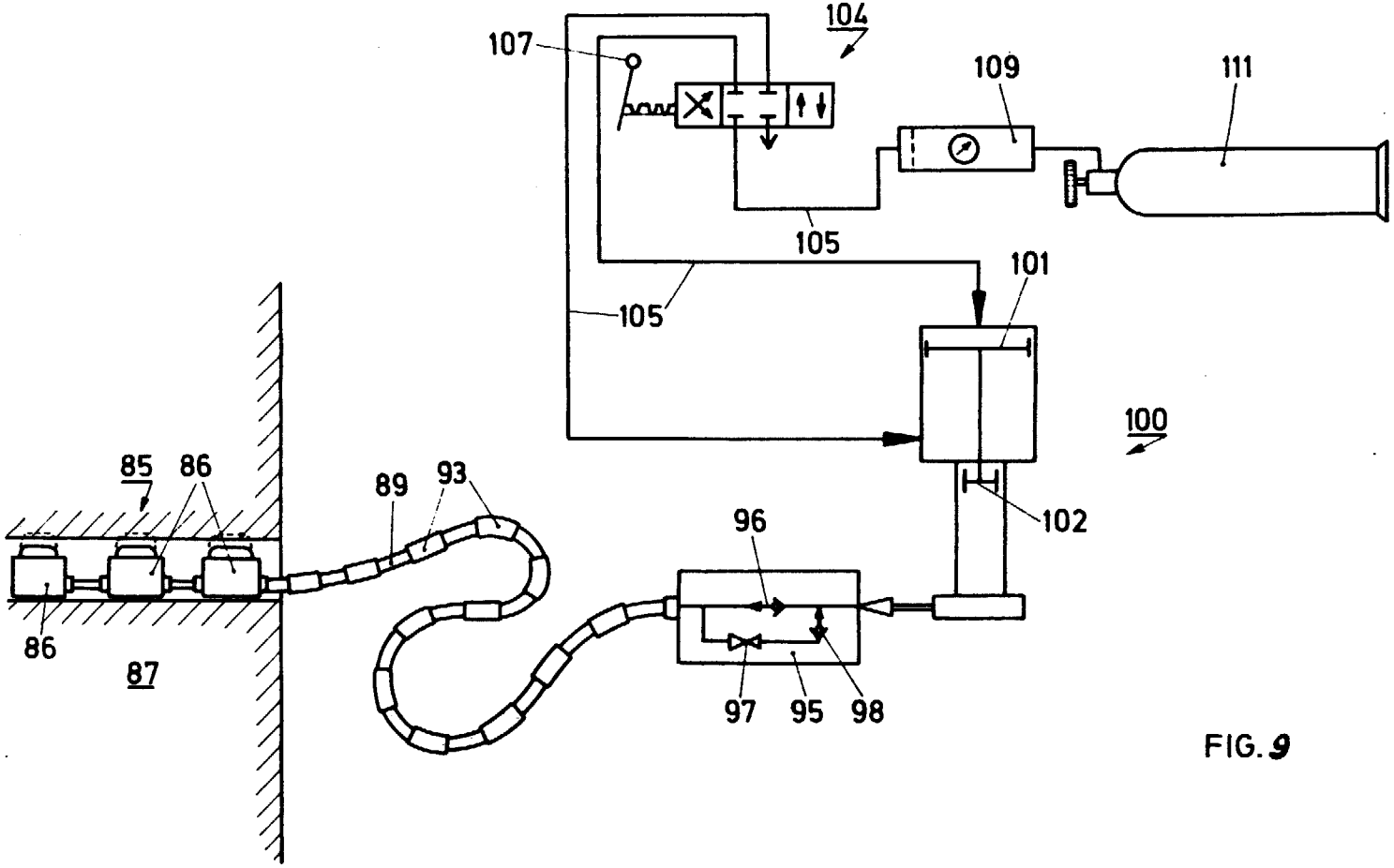
Figure 10:
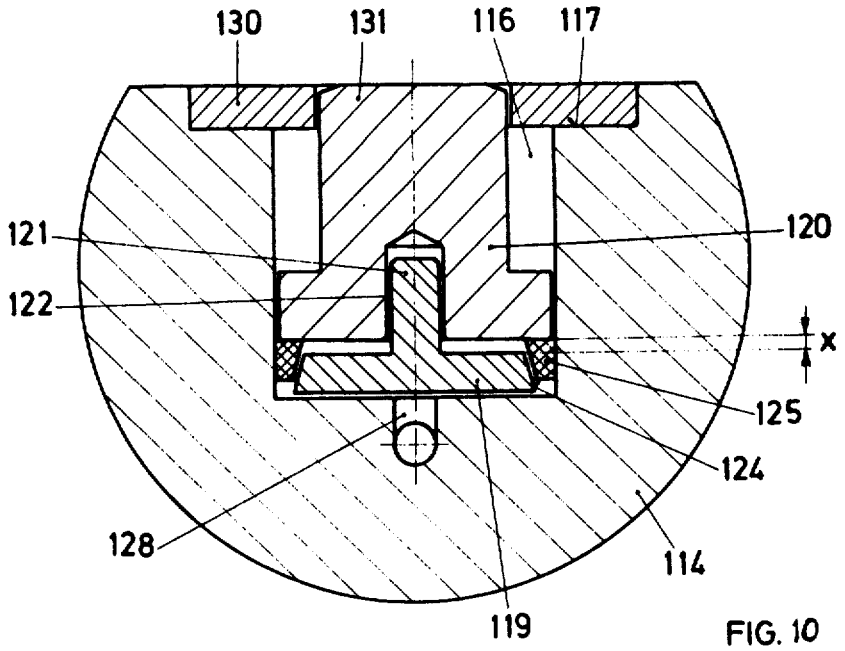
Figure 11:
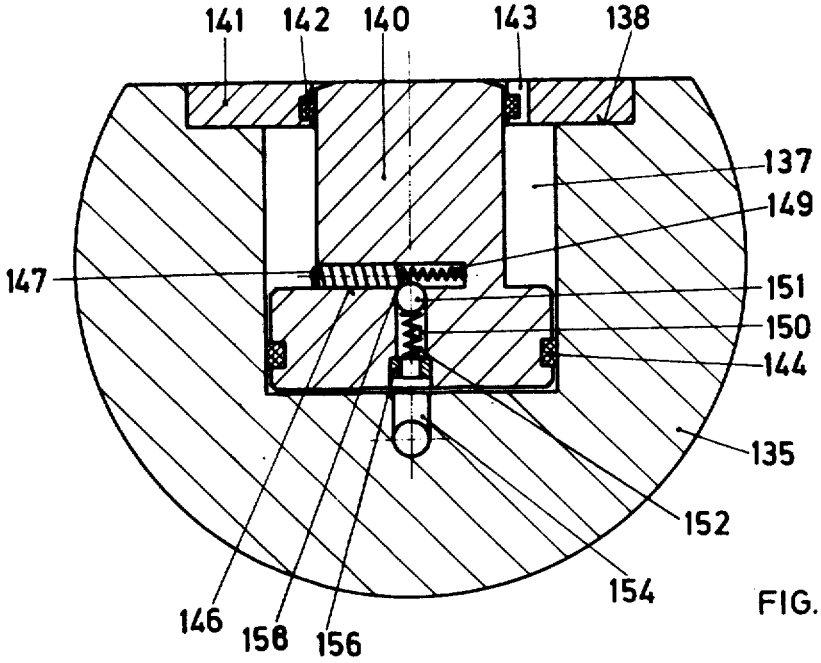
Figure 12:
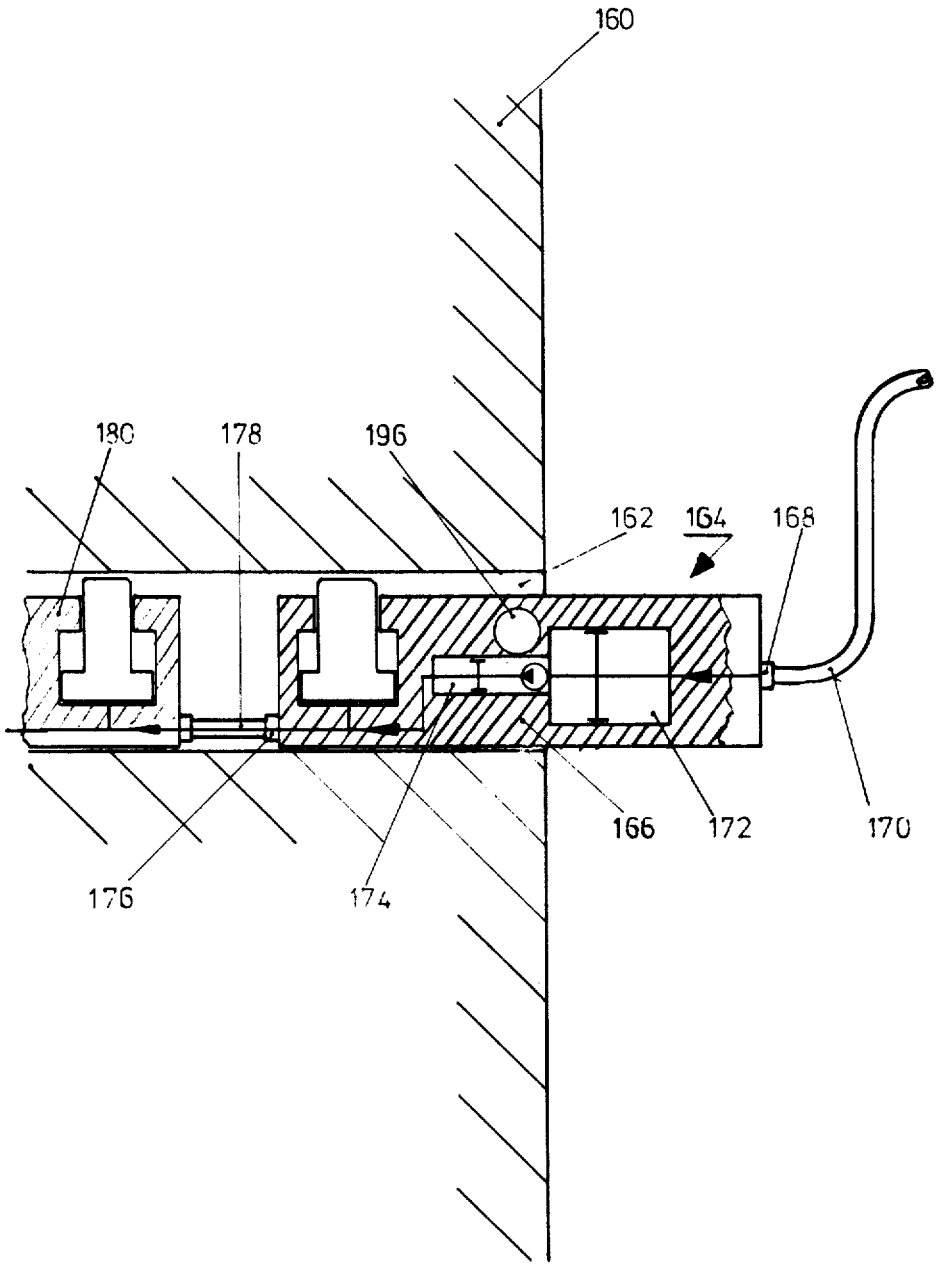
Figure 13:
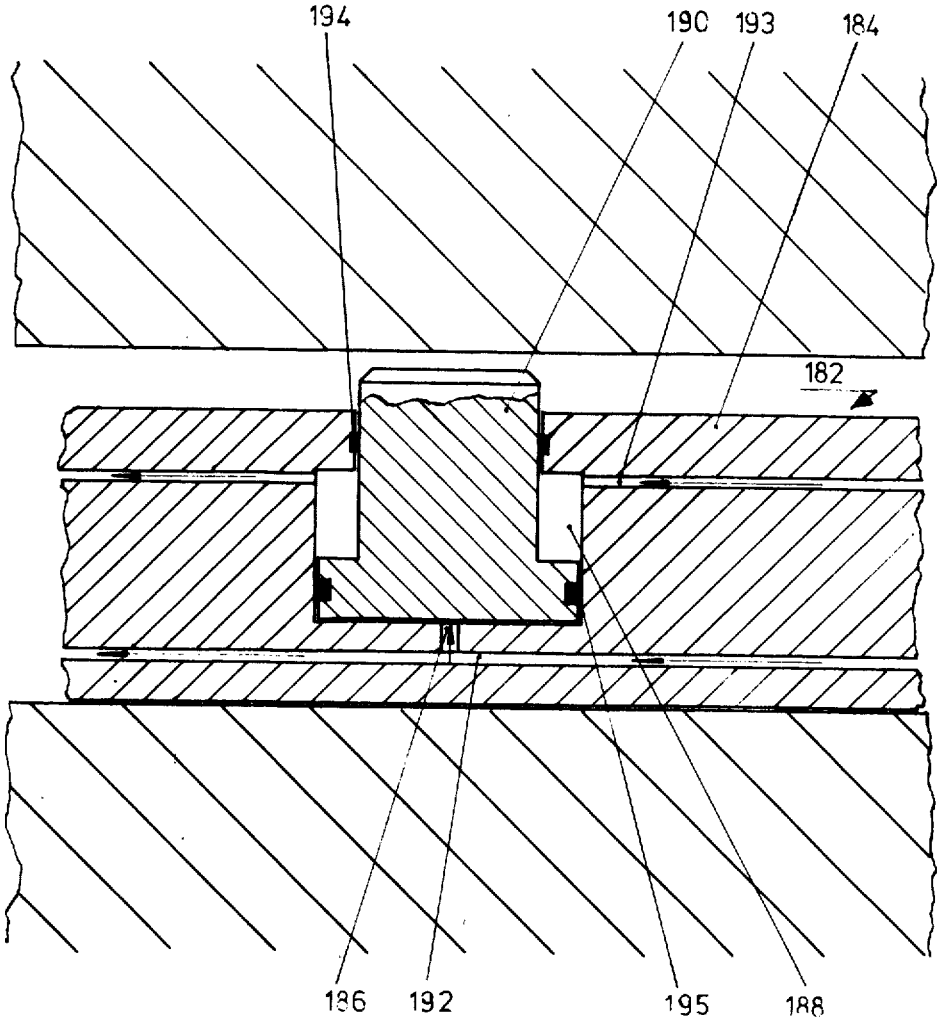

The invention is explained below by way of example with the aid of purely diagrammatical drawings, in which:

FIG. 1 is a section through an apparatus of an installation for the hydraulic breaking-up and/or for the breaking up by means of an explosive of, in particular, masonry and concrete structures, FIG. 2 is a section on the line II—II in FIG. 1, showing a portion of a structure and of an installed apparatus of the kind shown in FIG. 1, FIG. 3 is a similar section to that shown in FIG. 2, taken on line III—III in FIG. 1, FIG. 4 shows an explosive element for the unit-assembly system, with an explosive thrust piston, FIG. 5 is a section on the line V—V in FIG. 4 of an explosive element introduced into the base of a machine, after the explosion has taken place, FIG. 6 shown a portion of a concrete wall after blasting with a wedge-shaped thrust piston, FIG. 7 shows in purely diagrammatical form an apparatus comprising a plurality of serially disposed thrust pistons, FIG. 8 is a cross-section through a thrust piston in a casing, of the kind shown in FIG. 7, FIG. 9 shows diagrammatically an installation with apparatuses and appertaining auxiliary devices, FIG. 10 is a section through a casing provided with a piston, FIG. 11 shows an arrangement similar to that in FIG. 10, with built-in ventilation and safety systems, FIG. 12 shows part of an object which is to be demolished by explosive, with an explosive device inserted therein, and FIG. 13 shows part of an explosive device similar to that shown in FIG. 12.

FIG. 1 is a section through an apparatus comprising a carrier 1 having apertures 3 for the insertion of a coupling part 4 which enables carriers 1 of this kind to be arranged one behind the other or side by side in a unit-assembly system. In the example illustrated the carrier 1 is provided with two holes 5 and 6, a hydraulically operated thrust piston 8 being mounted for sliding in the hole 5 and a thrust piston 10 operated by explosive being similarly mounted in the hole 6. The thrust piston 10 is provided with a mushroom head 11, in order to reduce surface pressure when the explosion takes place. The hole 5 is supplied with hydraulic medium through a supply duct 13, while an explosive charge or a cartridge 15 can be seen in the hole 6. A detonator 17, which can be ignited by means of an ignition lead 18, is operatively connected to the cartridge 15. In addition, a concrete wall 19 after the explosion can be seen in FIGS. 2 and 3. In order to place the apparatus together with the carrier 1 in its working position in the concrete wall 19 which is to be demolished, a hole 21 is drilled or burned out in the wall. After the breaking-up operation a crack 22 is formed in the concrete wall 19.

Through the operation of suitable pistons (not shown) a hydraulic fluid, for example oil, is pumped through the hydraulic supply duct 13 into the bore 5, where it produces a lifting force corresponding to the size of the bottom surface of the thrust piston 8. This may amount to tons. With the aid of thrust pistons of this kind, which are connected serially and operated simultaneously, the force applied to the object which is to be broken up is such that it is either broken apart or placed under very considerable stress, for example stress to the yield point of the material or reinforcements which it is desired to break up. In the embodiment shown in FIGS. 1 and 3 the actual breaking up is effected by operating the explosive thrust piston 10, for which purpose the explosive charge 15 is detonated by means of the ignition lead 18 and the detonator 17, so that the pressure wave moves the piston 10 or drives the carrier 1 and the piston 10 apart in consequence of action and reaction and thus breaks apart the object which is to be demolished, in the present case the concrete wall 19.

The apparatus shown in FIG. 4 comprises a carrier 26 having a bore 28 in which an explosive thrust piston 30 is mounted for sliding. The piston 30 is provided with a mushroom head 31. A cartridge 33 is disposed beneath the piston 30 in the carrier 26 and is operatively connected to a detonator 34, to which an ignition lead 36 is fastened. In addition, it is possible to see the part of a machine base 38 which is to be broken up and in which a continuous crack 39, shown on a greatly enlarged scale, can already be seen.

Through the ignition of the detonator 34, the explosive thrust piston 38 is accelerated in the present case (it is also possible to provide a plurality of serially disposed pistons for simultaneous explosion), so that the piston 30 breaks apart the machine base 38 in the manner shown. One or more carriers coupled together in the manner shown in FIGS. 1 to 3 is or are inserted into the hole 28.

FIG. 6 shows another construction of an explosive device of this kind. This Figure relates to a concrete wall 45 in which a hole 47 has been drilled or burned. This hole serves to receive a pair of blasting jaws 49 provided with a conical slot 51. A cylindrical hole 55 is provided in an attached element 53 and receives a thrust piston 56, the front portion of which is in the form of a wedge 57. The cylindrical hole 55 contains a cartridge 59, which can be detonated in the manner explained. In addition, a pull-off attachment 62 can be seen which has a pull-back spindle 71 which engages in a threaded hole (not shown) in the thrust piston 56 and which when turned pulls back the thrust piston 56 together with the wedge 57 out of the conical slot 51 in the blasting jaws 49 after the explosion has occurred. A gap 64 in the concrete wall 45 can also be seen.

The explosion drives the wedge 57 into the conical slot 51 in the blasting jaws 49. The jaws 49 are pressed apart laterally and break apart the concrete wall 45.

The size of devices of this kind, together with their carriers, for the hydraulic and/or explosive breaking-up of objects is such that they can be received in an opening of a diameter of e.g. from 60 to 150 mm in the object.

In an installation of the kind shown in FIGS. 7 and 8, a number of devices with carriers or casings 70 are disposed one behind the other. Each of these casings 70 has a hole 72 in which a thrust piston 74 is mounted for sliding. The casings 70 are provided with a hydraulic supply bore 76, as shown in FIG. 8, which with the aid of a screw connection 77 is supplied through a corresponding supply pipe 78. These pipes 78 are provided with compensators 80. The thrust piston 74 may have either a flat end or a mushroom head 81. In addition, part of a pump connection pipe 83 can be seen.

The object of the compensator 80 is to provide the supply pipes 78, which are short and therefore very rigid, with flexibility in order to prevent the casing 70 from being unable to follow its piston, whereby jamming would occur between the piston and the casing, because of the possibly inclined surface which has to be lifted by the piston head and which attempts to change the position of the casing 70. It is naturally also possible for a plurality of pistons to be installed in one casing.

The installation shown in FIG. 9 comprises an apparatus 85 having three blasting units, which are inserted in an object 87 which is to be blasted, and which is likewise shown diagrammatically. The hydraulic medium is supplied through an armoured supply hose 89, which for the purpose of reinforcement is provided with pipe sleeves 93 or the like. A valve block 95 containing a non-return valve 96, a manually operated shut-off valve 97, and a second non-return valve 98 serves to control the installation. In addition, a pressure booster 100 having a large piston 101 and a small piston 102 is provided. The connection for the primary medium in the form of air is made by means of compressed air pipes 105, which connect a change-over unit 104 on the one hand to the pressure booster 100 and on the other hand, by way of a maintenance unit 109, to the compressed air supply cylinder 111. The mode of operation of the installation is self-explanatory . With the aid of the pressure booster it is possible to achieve pressures of from 3000 to 4000 atmospheres in the blast units, for which purpose the armoured supply hose 89 must be equipped with the previously mentioned pipe sleeves 93 or the like.

Instead of a high-pressure hose it is also possible to use a high-pressure pipe connection which is equipped with two or more swivel joints in order to achieve elasticity and adjustability of the two axes of the valve block hydraulic or blast elements during the positioning of the installation.

The blast piston shown in FIG. 10 is mounted in a casing 114 which is provided with a bore 116 and a recess 117. This bore receives a piston comprising a lower portion 119 and an upper portion 120 completely separate from the lower portion. The upper portion 120 of the piston has a bore 122 receiving a peg 121 on the lower part 119 of the piston, in the manner visible in FIG. 10. The lower portion 119 of the piston is provided with conical side surfaces 124, which are intended to lie against the seal 125 having a corresponding conical inner surface. The pressure medium is supplied through a supply bore 128. A cover plate 130 having a central aperture corresponding to the piston head 131 holds the piston portions 119 and 120 captive in the bore 116.

When during operation the pressure medium flows through the supply bore 128 into the bore 116, it pushes the lower part 119 of the piston against the upper part 120, whereby, in accordance with the thrust force and the resistance offered by the object which is to be demolished to the displacement of the upper part 120 of the piston, the conical seal 125 is correspondingly pressed against the wall of the bore 116 and with increasing pressure the sealing force is likewise increased. A limit to the increase of the sealing pressure is set by the distance X between the two piston parts 119 and 120. The value X shows the extent of the possible compression of the seal 125.

In the construction of a blast element shown in FIG. 11, a casing 135 is provided with a bore 137 and a recess 138. A stepped piston 140 is mounted for sliding in the bore 137. The bore 137 is closed by a plate 141, which has an aperture for the passage of the head of the piston 140, while a felt seal 142 ensures tightness. The plate 141 is provided with a through-hole 143. The stepped piston 140 is sealed by means of a piston seal 144. A lateral bore 146 in the piston receives a pin 147, which is for example grooved and which under the pressure of a coil spring 149 projects beyond the peripheral wall of the stepped piston 140, in the manner shown in FIG. 11. A central bore 150 in the stepped piston 140, in which bore the aperture leading into the lateral piston bore 146 is in the form of a ball valve seat 158, contains a ball 151 which under the pressure of a coil spring 152 is pressed against the ball valve seat 158. The coil spring 152 lies on an inserted element 156 in the bore 150. The working medium is supplied through a supply bore 154. During operation an oil pressure of for example 500 kp/cm$^2$ or substantially higher acts on the ball.

For demolition purposes the working medium is introduced into the casing bore 137 through the supply bore 154 and the piston 140 is raised. With increasing pressure the bore 151 is pressed with increasing force against the ball valve seat 158, so that the working medium cannot escape into the upper chamber of the bore 137.

When the stepped piston 140 now reaches its upper position, before the widened portion of the piston comes to bear against the plate 141, the inner edge of the plate 141 presses the pin 147 back into its bore 146 in the piston so that the pin pushes the bore 151 off the valve seat 158 and gives the pressure medium free access to the upper portion of the bore 137. The pressure medium then escapes upwards through the aperture 143 and damage to the apparatus is prevented. This arrangement also enables any air in the system to be forced out and makes it possible to check, through the emergence of pressure medium, that no air is flowing out through the aperture 143.

The apparatus described provides the following advantages:

- low price
- reduced weight
- rapid and convenient handling
- no external energy source, for example electricity, is required
- individual flexibility
- use of standardised high quality parts
- unit-assembly system.

FIG. 12 shows an object 160 which is to be demolished and which has a hole 162 for the insertion of an apparatus 164. The latter has a casing 166 having a low-pressure connection 168 (air pressure 100 to 200 atmospheres gauge or oil pressure 200 to 700 atmospheres gauge) and a low pressure supply hose 170. As indicated, the casing 166 contains in its interior a pressure convertor 172, which may at the same time be constructed as a pump connected to an oil tank 196 the high pressure side of which leads to a high pressure working piston 174. The casing 166 itself has an external high pressure connection 176, from which the apparatus 180 which is to be connected, or its working pistons, are fed by way of a high pressure connecting hose 178.

In this construction the working medium is supplied through the low pressure supply hose 170. For this purpose, for example, air at a pressure of about 200 atmospheres gauge or oil at a pressure up to about 700 atmospheres gauge is used. This medium passes to the low pressure side of the pressure converter 172 in which, as fully explained in connection with FIG. 3, the pressure is raised to for example up to about 5000 atmospheres gauge. Oil is preferably used as high pressure medium.

In this way it is possible for the operation with very high pressures to be performed inside the object 160 which is to be demolished, and on the outside to work with pressures which even in the event of a supply hose bursting cannot have a devastating effect on the environment and on the operating crew. This also results in fewer hose fractures, since the high pressure connecting hose 178 can naturally also be made in the form of a connecting pipe of metal provided with swivel joints. In this embodiment the external assembly is also substantially simpler because of the lower pressures. It does of course have the disadvantage of increased cost and greater weight of the installation, but optimum safety is ensured.

FIG. 13 shows part of an apparatus 182 having a casing 184. A first cylindrical chamber 186 and a second cylindrical chamber 188 are situated one on each side of a working piston 190. The cylindrical chamber 186 is in communication with a high pressure bore 192, while the cylindrical chamber 188 is in communication with a low pressure bore 193. The cylindrical chamber 186 is sealed by means of a very high pressure seal 195, while the working piston 190 is sealed in relation to the outside by means of a seal 194. These connections make it possible for the working piston 190 to be supplied with high pressure medium and to return it to its starting position by means of low pressure medium (air or oil). This method of returning the piston is considerably simpler and more reliable in operation than, for example, the use of springs or the like.

I claim:

1. An installation for breaking up an object, comprising a carrier, a hydraulically operated thrust piston mounted in the carrier, and an explosive-operated thrust piston mounted in the carrier.

2. The installation of claim 1, comprising a plurality of said carriers and coupling means interconnecting the carriers.

3. The installation of claim 1, wherein the explosive-operated thrust piston has a mushroom-shaped head.

4. The installation of claim 1, wherein the carrier has a cylindrical bore, the explosive-operated thrust piston being mounted in the bore, and ignition cap and detonator means mounted at the bottom of the bore.

5. The installation of claim 1, wherein the object has a blast bore having an inclined wall, and the explosive-operated thrust piston has a wedge-shaped attachment conforming to the inclined wall for insertion in the blast bore.

6. The installation of claim 5, further comprising means for pulling back the thrust piston with the wedge-shaped attachment out of the blast bore after the piston has been thrust into the bore by the explosive.

7. The installation of claim 1, comprising a plurality of said carriers, conduit means for supplying hydraulic fluid to the hydraulically operated thrust piston in each carrier, and flexible connections between the carriers and in communication with the conduit means for flow of the hydraulic fluid from a common source to all the carriers.

8. The installation of claim 7, further comprising a main armored supply hose between the common source and a first one of said carriers, and sleeve elements protecting the supply hose.

9. The installation of claim 8, further comprising a means for boosting the pressure of the fluid supplied to the main supply hose.

10. The installation of claim 1, wherein the carrier has a cylindrical bore, and the hydraulically operated thrust piston comprises two piston parts mounted in the bore, the piston parts having guide means for guiding one of the parts in respect of the other part in the bore.

11. The installation of claim 10, further comprising a piston seal in the bore, one of the piston parts having a conical circumference and the seal having a conical inner surface cooperating with the conical circumference of the one piston part.

12. The installation of claim 1, wherein the carrier has a cylindrical bore, and the hydraulically operated thrust piston has a stepped piston body consisting of a small diameter part connected to a large diameter part mounted in the bore, and further comprising a plate mounted on the carrier over the bore, the plate having an opening axially guiding the small diameter part of the piston body, a seal in the opening for sealing the small diameter part of the piston body, and the plate defining a ventilation passage permitting escape of hydraulic fluid from the bore.

13. The installation of claim 12, wherein the plate limits the stroke of the stepped piston body in the bore, and further comprising a safety means relieving further hydraulic load on the piston body before the large diameter piston body part reaches the plate.

14. The installation of claim 1, further comprising a means for boosting the pressure of hydraulic fluid supplied to the hydraulically operated thrust piston, the pressure boosting means comprising a piston loaded with compressed air at one side and the other side of the piston being in communication with the hydraulic fluid.

15. A method of breaking up an object comprising the steps of locating a hydraulically operated piston and an explosive operated piston within a hole in the object, while subjecting the object to a thrust from the hydraulic piston, additionally subjecting the object to a thrust from the explosive operated piston.

* * * * *